US008925767B2

(12) United States Patent
Iizuka et al.

(10) Patent No.: US 8,925,767 B2
(45) Date of Patent: Jan. 6, 2015

(54) CONTAINER WITH FOLDED-BACK BOTTOM WALL

(75) Inventors: Shigeo Iizuka, Tokyo (JP); Shigeru Hayakawa, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 117 days.

(21) Appl. No.: 13/144,146

(22) PCT Filed: Jan. 27, 2010

(86) PCT No.: PCT/JP2010/000456

§ 371 (c)(1),
(2), (4) Date: Jul. 25, 2011

(87) PCT Pub. No.: WO2010/087161

PCT Pub. Date: Aug. 5, 2010

(65) Prior Publication Data

US 2011/0278308 A1 Nov. 17, 2011

(30) Foreign Application Priority Data

Jan. 29, 2009 (JP) ..... 2009-018058
Aug. 28, 2009 (JP) ..... 2009-198655
Aug. 31, 2009 (JP) ..... 2009-199688

(51) Int. Cl.
*B65D 1/00* (2006.01)
*B65D 1/02* (2006.01)
*B05B 11/00* (2006.01)

(52) U.S. Cl.
CPC ..... *B65D 1/0261* (2013.01); *B65D 1/0292* (2013.01); *B05B 11/0037* (2013.01); *B05B 11/3001* (2013.01); *B65D 2231/00* (2013.01)
USPC ..... 222/321.5; 222/377; 222/464.7; 220/608

(58) Field of Classification Search
CPC ... B65D 1/0276; B65D 1/0292; B65D 1/0261
USPC ..... 222/321.5, 92, 206, 377, 321.7, 321.9, 222/464.7, 214–215, 382; 215/371; 220/608
See application file for complete search history.

(56) References Cited

U.S. PATENT DOCUMENTS 3,390,821 A * 7/1968 Mullan ..... 222/212
3,843,005 A * 10/1974 Uhlig ..... 215/373

(Continued)

FOREIGN PATENT DOCUMENTS

JP A-08-230961 9/1996
JP A-08-244749 9/1996

(Continued)

OTHER PUBLICATIONS

Dec. 18, 2012 Office Action issued in Korean Patent Application No. 10-2011-7017397 (with translation).

(Continued)

*Primary Examiner* — Kevin P Shaver
*Assistant Examiner* — Michael J Melaragno
(74) *Attorney, Agent, or Firm* — Oliff PLC

(57) ABSTRACT

A container with a folded-back bottom wall, which is very stable in a rest position, has a strong bottom wall, and makes it possible to minimize the amount of remaining liquid while allowing costs to be reduced is provided. The container with a folded-back bottom wall has a bottom wall and a body part and transforms into a first mode in which the bottom wall is made to project downwards from the lower surface of the body part, and into a second mode in which the bottom wall is folded back inside the body part. The boundary portion between the bottom wall and the body part is folded to have an outwardly-convex shape so that a folding groove is circumferentially formed, and the bottom wall is folded back inside the body part at the folding groove.

20 Claims, 14 Drawing Sheets

(56) References Cited

U.S. PATENT DOCUMENTS

| | | | | |
|---|---|---|---|---|
| 4,470,526 | A * | 9/1984 | Cha et al. | 222/320 |
| 5,062,549 | A * | 11/1991 | Smith et al. | 222/377 |
| 5,522,548 | A * | 6/1996 | Gallien et al. | 239/337 |
| 6,460,740 | B2 * | 10/2002 | Simard | 222/382 |
| 6,752,297 | B1 * | 6/2004 | Ische | 222/464.7 |
| 7,007,827 | B1 * | 3/2006 | Li | 222/321.9 |
| 7,048,132 | B2 | 5/2006 | Yamanaka et al. | |
| 8,181,831 | B2 * | 5/2012 | Chapin | 222/377 |
| 8,281,960 | B1 * | 10/2012 | Gers | 222/377 |
| 2005/0072752 | A1 | 4/2005 | Yamanaka et al. | |
| 2006/0138074 | A1 * | 6/2006 | Melrose | 215/373 |
| 2006/0186144 | A1 * | 8/2006 | Tinsley | 222/377 |
| 2007/0199915 | A1 * | 8/2007 | Denner et al. | 215/375 |
| 2008/0023499 | A1 * | 1/2008 | Knight | 222/464.7 |
| 2008/0121664 | A1 * | 5/2008 | Ophardt et al. | 222/321.9 |
| 2008/0302831 | A1 * | 12/2008 | Wang | 222/321.5 |
| 2009/0008414 | A1 * | 1/2009 | Tingsley | 222/377 |
| 2009/0230153 | A1 * | 9/2009 | Knight | 222/383.1 |

FOREIGN PATENT DOCUMENTS

| | | | |
|---|---|---|---|
| JP | A-10-007121 | | 1/1998 |
| JP | A-10-194317 | | 7/1998 |
| JP | A-10-323586 | | 12/1998 |
| KR | 2005/0061326 | A | 6/2005 |
| WO | WO 2006/034231 | A1 | 3/2006 |

OTHER PUBLICATIONS

International Search Report issued in Application No. PCT/JP2010/000456; Dated Feb. 23, 2010 (With Translation).

Feb. 26, 2013 Extended European Search Report issued in European Patent Application No. 13151308.

Dec. 27, 2012 Canadian Office Action issued in Canadian Patent Application No. 2,750,289.

European Patent Office Communication issued in Application No. 13 151 308.7 mailed Jan. 20, 2014.

* cited by examiner

CONTAINER WITH FOLDED-BACK BOTTOM WALL

TECHNICAL FIELD

The present invention relates to a container with a folded-back bottom wall in which a bottom wall is folded back inside a body part after molding, and in particular, to a container with a folded-back bottom wall in which a suction pipe is hung down from a liquid discharging pump mounted on a body part into the body part.

RELATED ART

There is conventionally known a container in which a liquid discharging pump is mounted on an opening neck part extending upward from the upper end of a body part, and a suction pipe is hung down from the liquid discharging pump into the body part, allowing liquid in the body part to be sucked up and discharged through the suction pipe upon actuation of the liquid discharging pump.

RELATED ART DOCUMENT

Patent Document

Patent Document 1: Japanese Patent Laid-Open No. H08-230961 (JP 8230961 A)

Patent Document 2: Japanese Patent Laid-Open No. H10-194317 (JP 10194317 A)

DISCLOSURE OF THE INVENTION

Problems to be Solved by the Invention

In the prior art container, the suction pipe is folded in such a way that its lower end is located around a peripheral edge of the bottom wall in order to minimize the amount of liquid remaining in the body part. However, there is a problem that a dedicated gadget is required to fold the suction pipe, leading to increased costs.

The present invention has been made to solve the above-mentioned problem. An object of the present invention is to provide a container with a folded-back bottom wall, which is very stable when a plurality of such containers are stacked, has a strong bottom wall, and makes it possible to minimize the amount of remaining product while allowing costs to be reduced.

Means for Solving the Problem

To solve the problem, the present invention provides a container with a folded-back bottom wall having a bottom wall and a body part and transforming into a first mode A in which the bottom wall projects downwards from a lower surface of the body part and into a second mode B in which the bottom wall is folded back inside the body part, wherein a boundary portion between the bottom wall and the body part is folded to have an outwardly-convex shape so that a folding groove is circumferentially formed, and the bottom wall is folded back inside the body part at the folding groove.

According to the present invention, a folding line may also be formed along an opening upper edge of the folding groove as the bottom wall is folded back inside the body part.

In addition, according to the present invention, the folding groove may have a cross sectional shape of a round U- or square U-shape.

Moreover, according to the present invention, a liquid discharging pump may be mounted on an opening neck part extending upward from an upper end of the body part, and a suction pipe is hung down from the liquid discharging pump into the body part, allowing liquid in the body part to be sucked up and discharged through the suction pipe upon actuation of the liquid discharging pump, and the bottom wall may have a truncated cone-shaped peripheral wall extending upward from a lower end of the body part into the interior of the body part; a top surface of the peripheral wall is inclined obliquely downward and forward; the top surface of the peripheral wall is recessed to form a liquid retaining part; and a lower end of the suction pipe may be hung down into the liquid retaining part.

Further, according to the present invention, in the second mode B, a constricted part may be provided at a lower end portion of the body part, and an area of the body part located below the constricted part is brought into contact with a lower portion of the -truncated cone-shaped peripheral wall to form a cylindrical leg for resting.

The present invention also provides a container with a folded-back bottom wall having a bottom wall and a body part and transforming into a first mode A in which the bottom wall projects downwards from a lower surface of the body part and into a second mode B in which the bottom wall is folded back inside the body part, the container further comprising a liquid discharging pump mounted on an opening neck part extending upward from an upper end of the body part and a suction pipe hung down from the liquid discharging pump into the body part, allowing liquid in the body part to be sucked up and discharged through the suction pipe upon actuation of the liquid discharging pump, wherein in the second mode B, a truncated cone-shaped peripheral wall extends upward from a lower end of the body part into the interior of the body part; a top surface of the peripheral wall is inclined obliquely downward and forward; the top surface of the peripheral wall is recessed to form a liquid retaining part so that any liquid remaining in a gap S between an outer surface of the truncated cone-shaped peripheral wall and an inner surface of the body part is allowed to flow over an upper end of the truncated cone-shaped peripheral wall into the liquid retaining part; and a lower end of the suction pipe is hung down into the liquid retaining part.

In addition, according to the present invention, in the second mode B, a constricted part may be provided at a lower end portion of the body part, and an area of the body part located below the constricted part is brought into contact with a lower portion of the truncated cone-shaped peripheral wall to form a cylindrical leg for resting.

Moreover, according to the present invention, the liquid retaining part may be formed from a bottom surface inclined obliquely downward and backward, and a peripheral surface extending obliquely upward and outward from a peripheral edge of the bottom surface and merging in an upper end of the truncated cone-shaped peripheral wall.

Further, according to the present invention, in the first mode A, a peripheral wall is hung down from a lower end of the body part, and a lower surface of the peripheral wall is inclined obliquely upward and forward and recessed so as to provide a bottom surface-forming surface inclined obliquely upward and forward and a peripheral surface-forming surface extending obliquely upward and outward from a peripheral edge of the bottom surface-forming surface and merging in the lower end of the peripheral wall.

Still further, according to the present invention, at least rear part of a lower surface of the suction pipe may be inclined obliquely upward and backward.

The present invention also provides a container with a folded-back bottom wall having a bottom wall and a body part and transforming into a first mode A in which the bottom wall projects downwards from a lower surface of the body part and into a second mode B in which the bottom wall is folded back inside the body part, the container further comprising a liquid discharging pump mounted on an opening neck part extending upward from an upper end of the body part and a suction pipe hung down from the liquid discharging pump into the body part, allowing liquid in the body part to be sucked up and discharged through the suction pipe upon actuation of the liquid discharging pump, wherein the body part comprises a V-groove extending in the circumferential direction at a part of its lower portion, the V-groove being formed by reducing the diameter of the body part, in the second mode B, a truncated cone-shaped peripheral wall extends upward from a lower end of the body part into the interior of the body part; a top surface of the peripheral wall is inclined obliquely downward and forward; the top surface of the peripheral wall is recessed to form a liquid retaining part; an area of the body part located below a bottom part of the V-groove is brought into watertightly contact with the truncated cone-shaped peripheral wall to form a cylindrical leg; a top surface of the cylindrical leg is formed into a tapered surface inclined obliquely downward and forward; and the suction pipe is hung down into the liquid retaining part in a linear manner.

In addition, according to the present invention, a recess may be formed in the liquid retaining part on an area of a bottom surface located below the suction pipe, and a recessed groove for a flow channel is provided, the recessed groove for a flow channel having its front end open to the recess and its rear end open to an upper end of a front part of the truncated cone-shaped peripheral wall.

Moreover, according to the present invention, a boundary portion between the bottom wall and the body part may be folded to have an outwardly-convex shape so that a folding groove is circumferentially formed, and a folding line may be formed along an opening upper edge of the folding groove as the bottom wall is folded inside the body part.

Effect of the Invention

The present invention is configured as follows: a boundary portion between the bottom wall and the body part is folded so that a folding groove is circumferentially formed, and the bottom wall is folded back inside the body part at the folding groove. Accordingly, the bottom wall and the body part do not need to have different thicknesses in order to allow the bottom wall to be folded back, and variations in thickness are unlikely to occur at the boundary between the bottom wall and the body part, which allows the bottom wall to be folded back in a uniform manner. Therefore, the present invention provides better stability in a rest position, while achieving improved strength.

In this case, the present invention may also be configured so that a folding line is formed along an opening upper edge of the folding groove.

In addition, the present invention is configured in such a way that any liquid being trapped in a gap between the rear outer surface of a truncated cone-shaped peripheral wall and the inner surface of the body part is allowed to flow into a liquid retaining part, and the lower end of a linear suction pipe is hung down into the liquid retaining part. As such, the amount of liquid remaining in the body part can be reduced and a linear suction pipe can be used, which may eliminate the need to fold the pipe and lead to reduced costs.

Moreover, according to the present invention, the bottom wall transform into a first mode in which the bottom wall projects downwards and outwards from the body part, and into a second mode in which the bottom wall is folded back inside the body part. This enables the bottom wall to be formed in the first mode during production, which mode facilitates production, and to transform into the second mode after production, in which mode the bottom wall has a shape capable of minimizing the amount of remaining product in conjunction with the suction pipe and may keep a stable rest position.

In the second mode, the strength of the lower portion of the body part is improved since the top surface of a truncated cone-shaped peripheral wall is recessed; a liquid retaining part is provided such that any liquid left around the liquid retaining part is allowed to flow into the liquid retaining part; and the lower end of the suction pipe is hung down into the liquid retaining part. This may minimize the amount of liquid remaining in the body part.

In addition, an area of the body part located below the constricted part is formed into a cylindrical leg, which in turn is taken as a resting part. This allows the container to be placed in a stable state, and may improve the strength of the lower portion of the body part as each cylindrical leg contains a double wall.

Moreover, according to the present invention, the top surface of the cylindrical leg is formed into a tapered surface which is inclined obliquely downward and forward. Thus, a gap between the inner surface of an area of the body part that is located above a V-groove formed at the lower portion of the body part and the outer surface of the truncated cone-shaped peripheral wall is located above the lowermost point of the truncated cone-shaped peripheral wall. As a result, all the liquid contained in this gap should flow into the liquid retaining part, which may minimize the amount of remaining liquid.

Since a recess and a recessed groove for a flow channel are formed at a part of the bottom surface that is located below the suction pipe, the amount of remaining liquid may be further reduced by positioning the lower end of the suction pipe in the recess for accumulating liquid, in combination with the above-mentioned features.

As the boundary portion between the bottom wall and the body part is folded to have an outwardly-convex shape to circumferentially form a folding groove, the bottom wall may be folded back inside the body part, without providing the bottom wall and the body part with different thicknesses. Accordingly, this eliminates height variation in the folded part that would otherwise be caused by variation in thickness, and thereby increases the stability of the container.

BEST MODE FOR CARRYING OUT THE INVENTION

Figure 1:
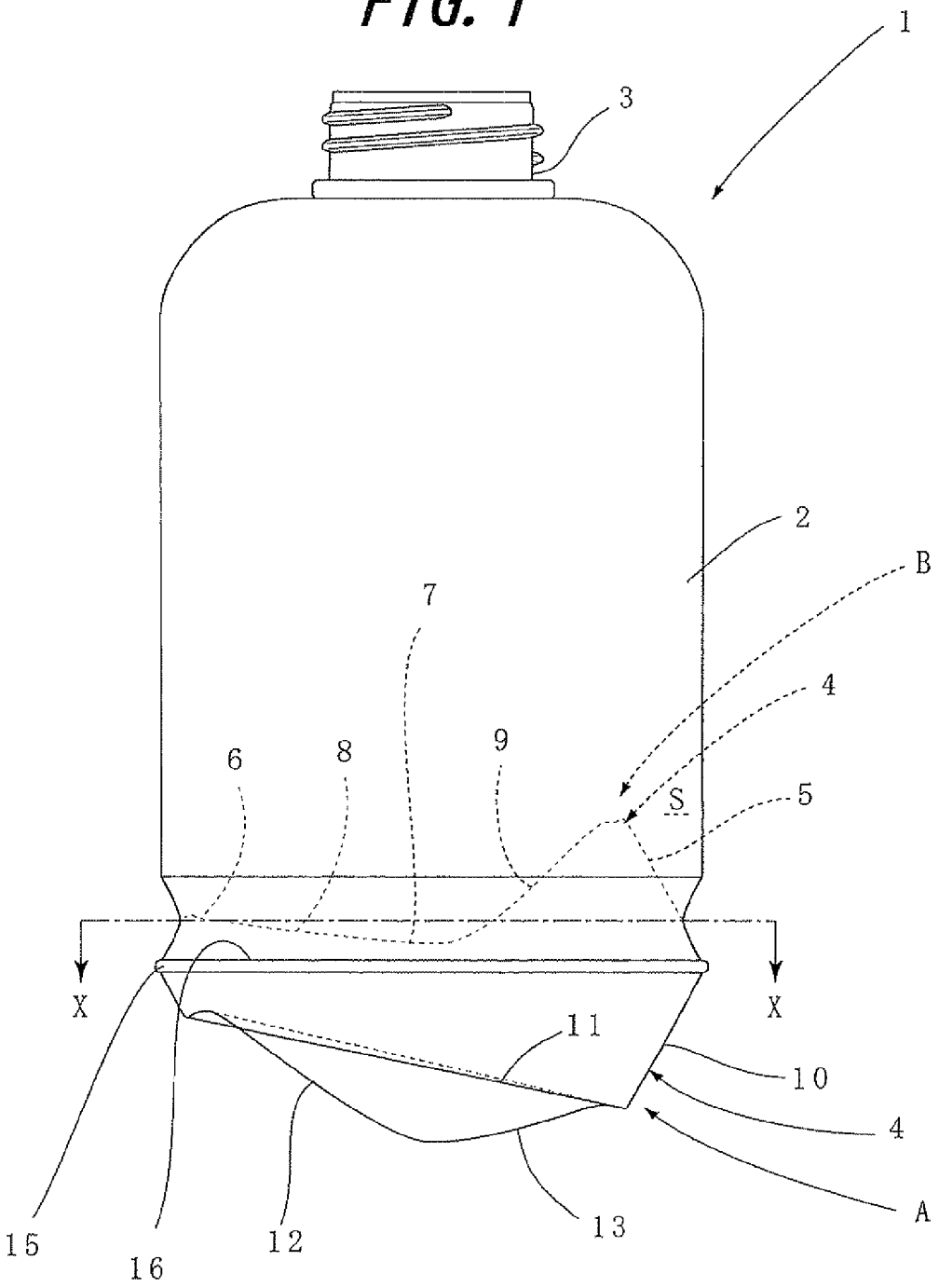
FIG. 1 is a front view of a container with a folded-back bottom wall according to the present invention.
Figure 2:
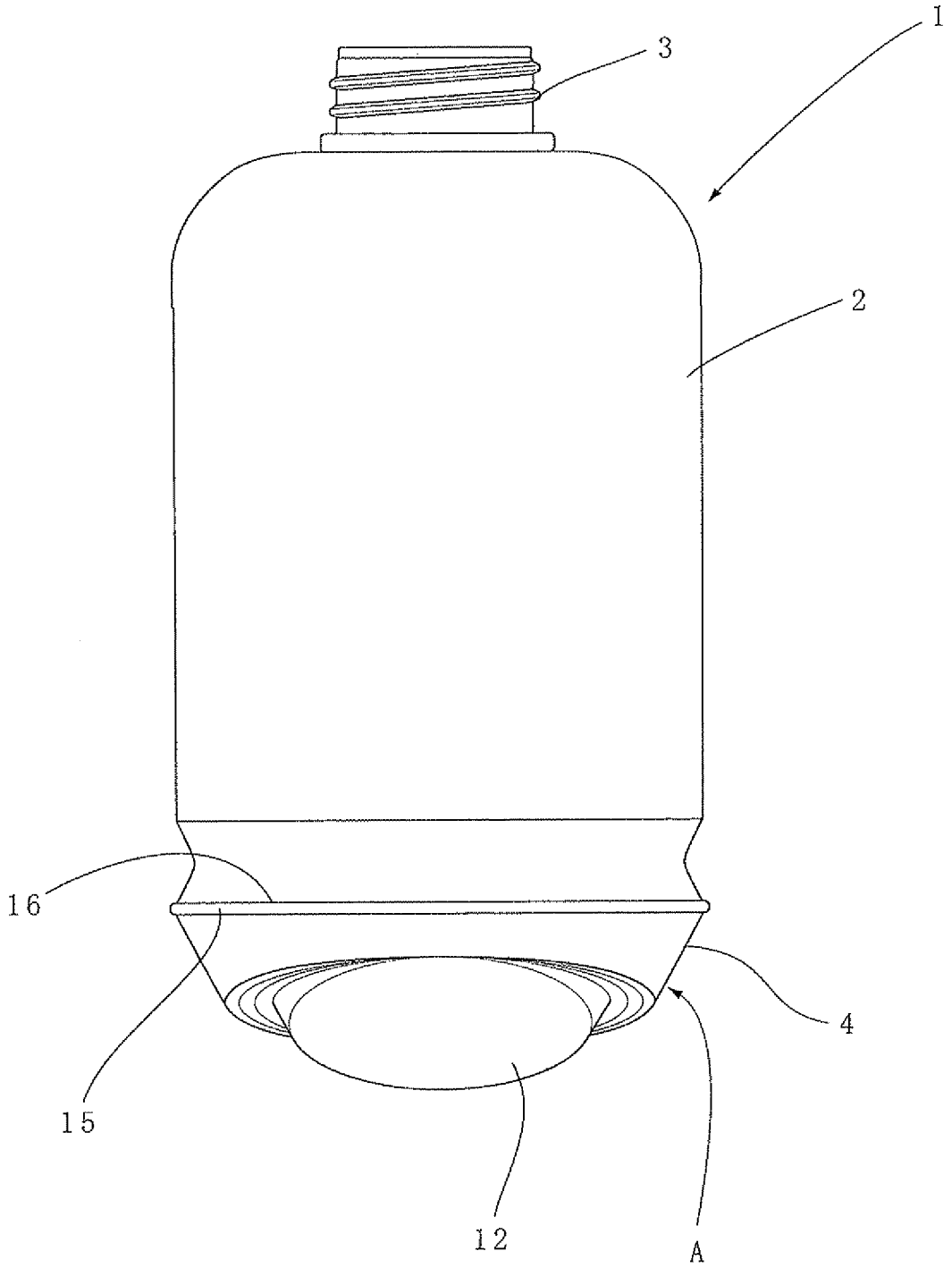
FIG. 2 is a left side view of FIG. 1.
Figure 3:
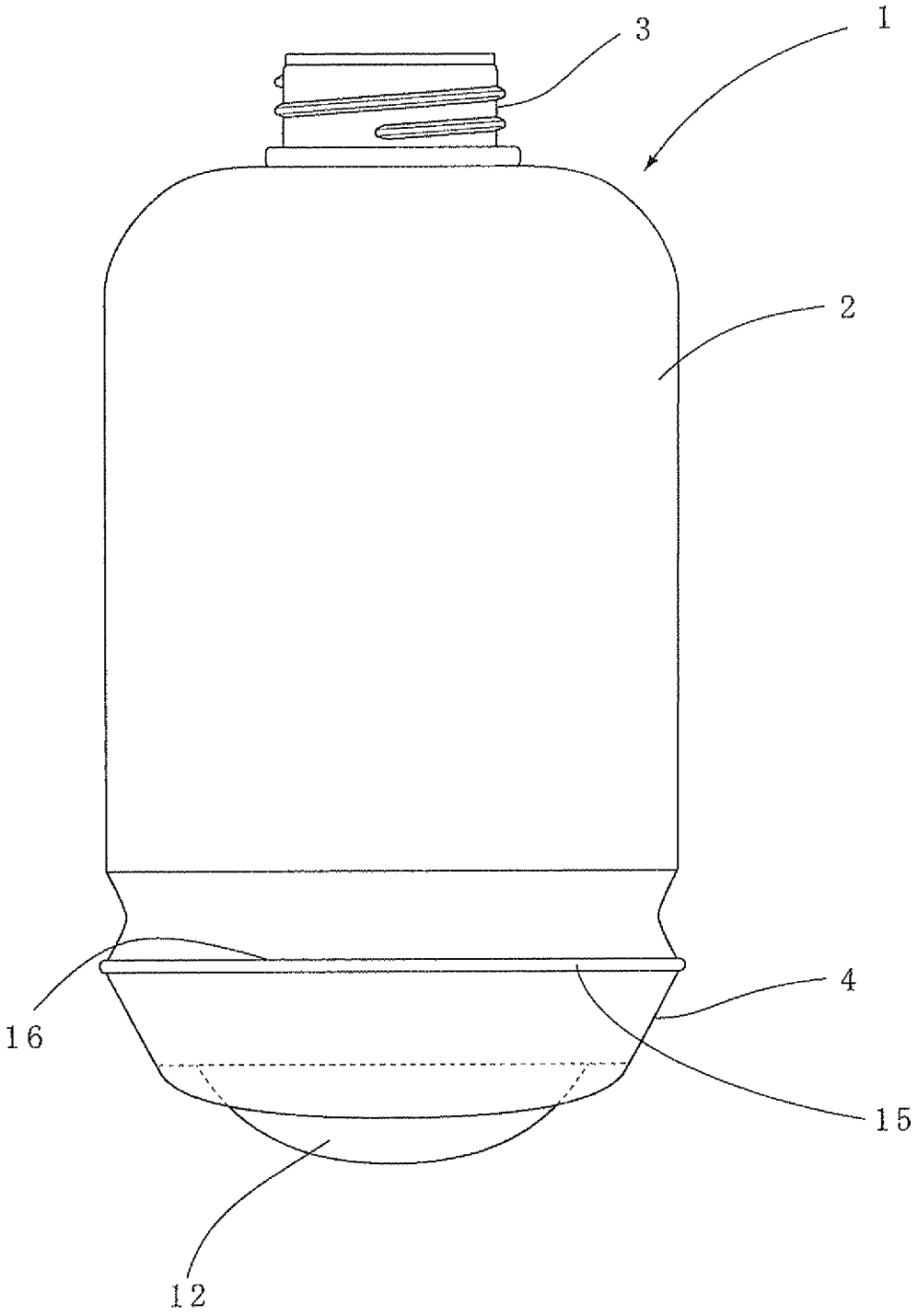
FIG. 3 is a right side view of FIG. 1.
Figure 4:
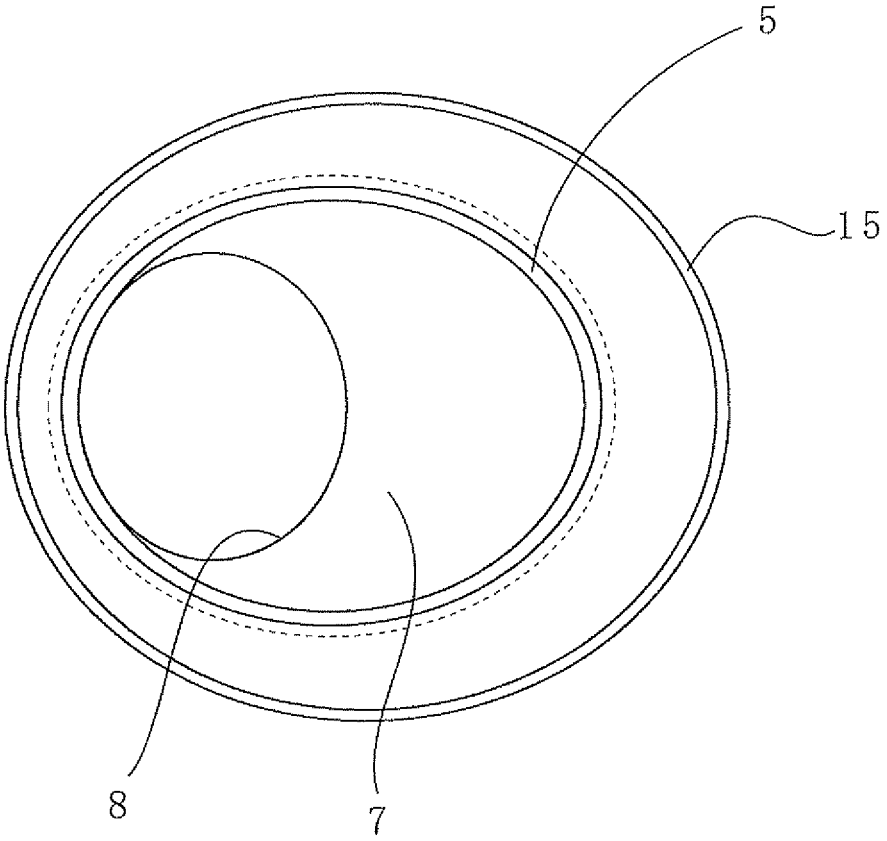
FIG. 4 is a cross-sectional view taken along the line X-X of FIG. 1.
Figure 5:
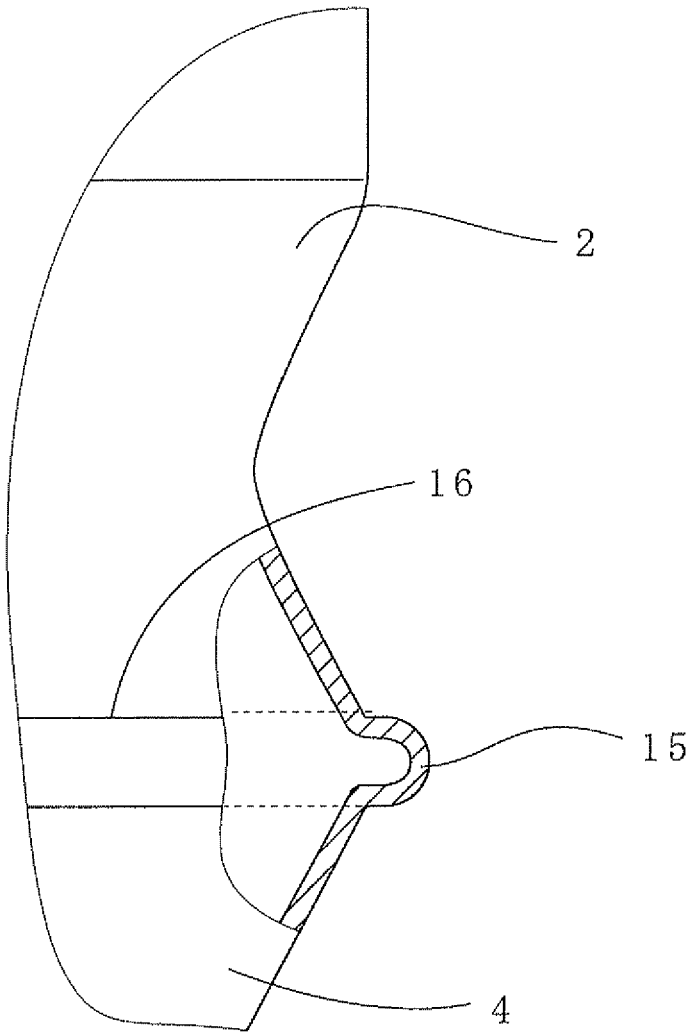
FIG. 5 is an enlarged view of major parts of FIG. 1.
Figure 6:
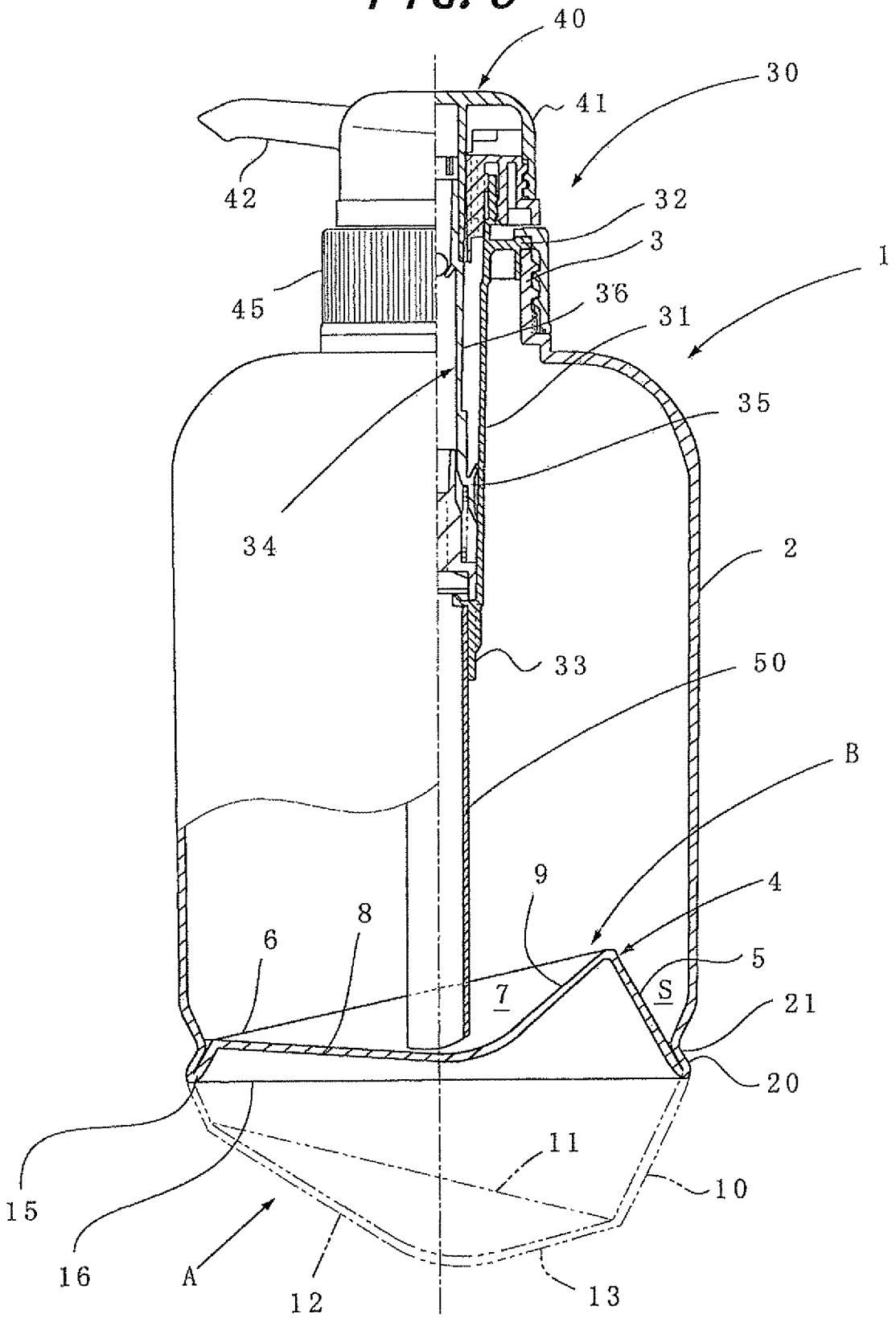
FIG. 6 is a partially sectioned front view with a liquid discharging pump mounted on the container of FIG. 1.
Figure 7:
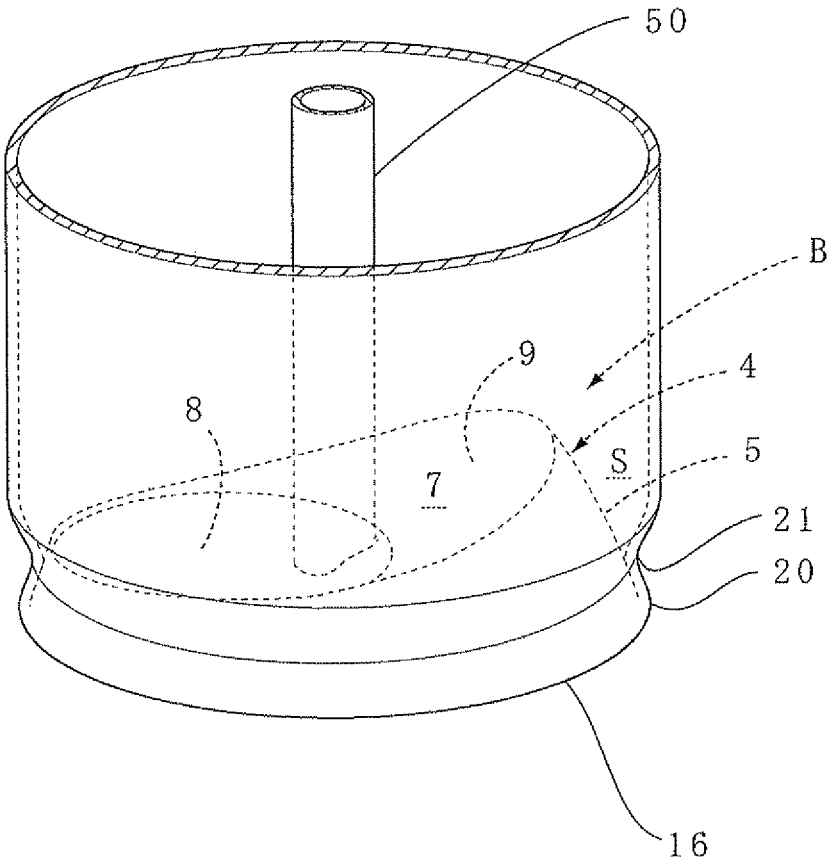
FIG. 7 is a perspective view illustrating a part of the container with the bottom wall folded back

Embodiments of the present invention will now be described in detail below with reference to the accompanying drawings, firstly to FIG. 1 to FIG. 7.

A container, which is designated by the reference numeral 1, has an opening neck part 3 extending upward from the upper end of a body part 2 through a shoulder, and a liquid discharging pump mounted on the opening neck part 3 as described below.

A bottom wall 4, which terminates the lower end face of the body part 2, has a first mode A in which the bottom wall projects downwards from the lower surface of a body part, and a second mode B in which the bottom wall is folded back inside the body part. Firstly, the second mode B, which represents a mode used in discharging, is described below.

The bottom wall 4 in the second mode B has a truncated cone-shaped peripheral wall 5 extending upward from the lower end of the body part 2 into the interior of the body part, and the top surface 6 of the peripheral wall is inclined obliquely downward and forward. In addition, the top surface 6 of the peripheral wall is recessed to form a liquid retaining part 7.

The liquid retaining part 7 is formed from: a bottom surface 8 which is inclined obliquely downward and backward; and a peripheral surface 9 which extends obliquely upward and outward from the peripheral edge of the bottom surface 8 and merges in the upper end of the truncated cone-shaped peripheral wall 5.

In this way, since the upper end of the truncated cone-shaped peripheral wall 5 is inclined obliquely downward and forward, any liquid that is trapped in a gap S between the outer surface of the peripheral wall and the inner surface of the body part is still allowed to flow into the liquid retaining part 7 if the amount of liquid in the container is reduced.

Then, the first mode A, which represents a form during molding, is described below. In the first mode A, the bottom wall 4 is formed from the following: a truncated cone-shaped peripheral wall 10 is hung down from the lower end of the body part 2, and a lower surface 11 of the peripheral wall is inclined obliquely upward and forward and protrudes downwards so as to provide a bottom surface-forming surface 12 inclined obliquely upward and forward and a peripheral surface-forming surface 13 extending obliquely upward and outward from a peripheral edge of the bottom surface-forming surface 12 and merging in the lower end of the peripheral wall 10.

Moreover, a boundary portion between the body part 2 and the bottom wall 4 is folded to circumferentially form a folding groove 15 which opens inward. The folding groove 15 is provided in order to allow the bottom wall 4 to be folded back inside the body part 2 along an opening upper edge 16 of the folding groove 15 as a folding line when the bottom wall 4 is pushed into the body part 2 for fold-back. However, it may also be configured so that folding lines are formed at one or more areas of the folding groove. For example, the bottom wall 4 may be folded back so that folding lines are formed at an area of a curved portion of the folding groove.

Preferably, the folding groove 15 has a cross sectional shape, typically including, but not limited to, round U- or square U-shapes.

A cylindrical leg, which is designated by the reference numeral 20, is formed by providing a lower end portion of the body part 2 with a constricted part 21 and bringing an area of the body part 2 located below the constricted part 21 into contact with a lower end portion of the truncated cone-shaped peripheral wall 5. The cylindrical leg 20 serves as a resting part when the container is placed on a resting surface.

A liquid discharging pump, which is designated by the reference numeral 30, includes a cylinder. The cylinder has an outwardly directed flange 32 which is attached to the upper outer surface of a cylinder main body 31 hung down into the body part 2. The outwardly directed flange 32 is placed on the upper end of the opening neck part 3. Moreover, a suction valve is attached to a lower portion of the cylinder main body 31, and a fitting tube 33 for fitting a suction pipe is hung down from the lower end of the cylinder main body 31.

An actuation member, which is designated by the reference numeral 34, is fitted and inserted into the cylinder main body 31 in a vertically movable manner. The actuation member 34 has a stem 36 which extends upward from a tubular piston 35, which in turn is fitted into the cylinder main body 31 in a vertically movable manner.

A nozzle head, which is designated by the reference numeral 40, has a head main body 41 which is fitted into the upper end of the stem 36, and a nozzle 42 which projects forward from the head main body 41. A cap, which is designated by the reference numeral 45, has an inwardly directed flange. The inwardly directed flange is provided at the upper end of a tubular body screwed into the outer surface of the opening neck part 3. The outwardly directed flange 32 of the cylinder main body 31 is sandwiched between this inwardly directed flange and the upper end of the opening neck part 3.

A suction pipe, which is designated by the reference numeral 50, has its upper portion fitted into the fitting tube 33 hung down from the lower end of the cylinder main body 31, and its lower end hung down into the liquid retaining part 7 of the bottom wall 4. This suction pipe 50 preferably has its lower end located at the deepest part of the liquid retaining part 7 in terms of minimizing the amount of remaining product. The suction pipe 50 preferably extends in a linear manner rather than bends in a dogleg shape as seen in conventional products. In addition, a rear part of the lower end of the suction pipe 50 is preferably inclined obliquely upward and backward.

Next, operations of the present invention are described below.

During molding, the bottom wall 4 is molded into the first mode A. After molding, once the bottom wall 4 in the first mode A is pushed into the body part 2, the bottom wall 4 is folded back inside the body part 2 along the folding groove 15 (e.g., the opening upper edge 16 of the folding groove) as a folding line.

In the second mode B, when the nozzle head 40 is pressed downward, liquid in the body part is discharged from the nozzle 42 through the suction pipe 50 and the actuation member 34 in a desired manner. When the liquid in the body part is reduced, the liquid is trapped in the liquid retaining part 7. In this state, the lower end of the suction pipe 50 is in close proximity to the bottom surface of the liquid retaining part 7, so that the amount of remaining liquid can be minimized. It should be noted that any remaining liquid in a gap S between the outer surface of the peripheral wall and the inner surface of the body part is allowed to flow into the liquid retaining part 7 since the upper end of the truncated cone-shaped peripheral wall 5 is inclined obliquely downward and forward.

Figure 8:
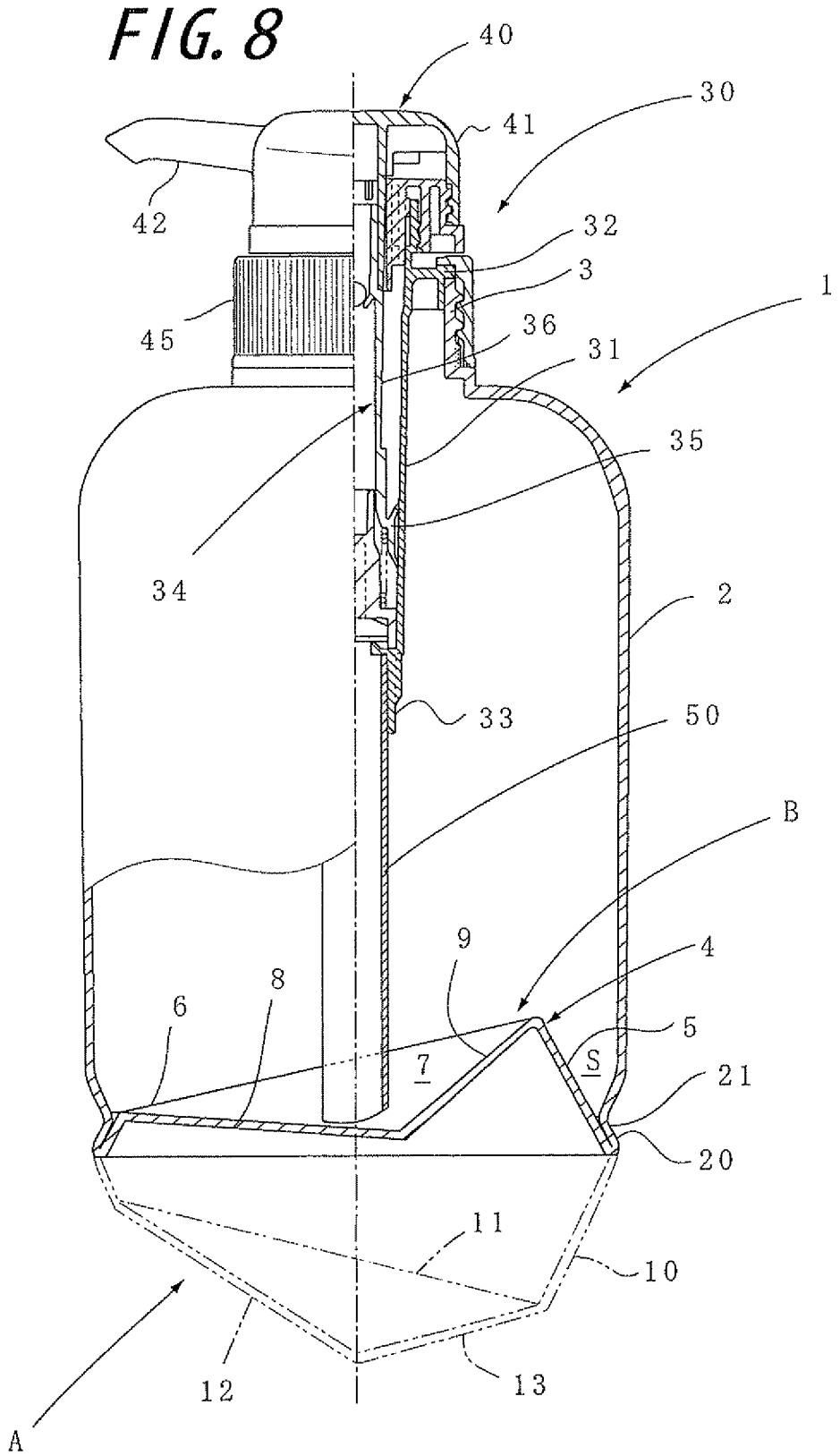
FIG. 8 is a cross-sectional view of another embodiment of the container with a folded-back bottom wall according to the present invention when a liquid discharging pump is mounted.
Figure 9:
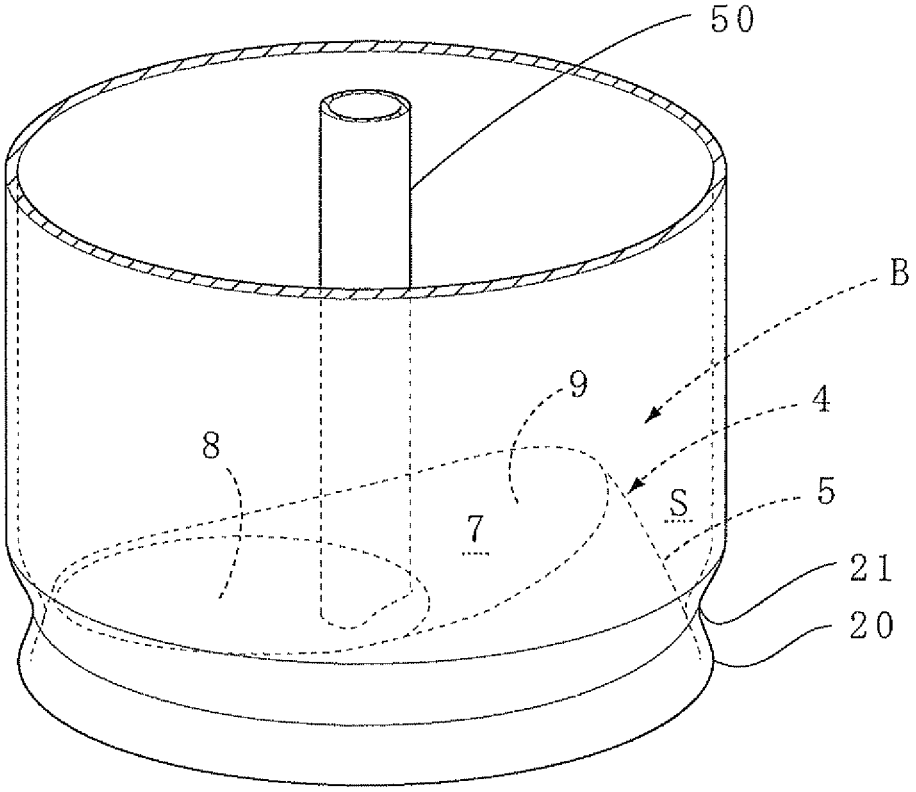
FIG. 9 is a perspective view illustrating a second mode B of the container with a folded-back bottom wall illustrated in FIG. 8.

Another embodiment according to the present invention will now be described in detail below with reference to FIGS. 8 and 9.

A container, which is designated by the reference numeral 1, has an opening neck part 3 extending upward from the upper end of a body part 2 through a shoulder, and a below-mentioned liquid discharging pump is mounted on the opening neck part 3.

A bottom wall 4, which terminates the lower end face of the body part 2, has a first mode A in which the bottom wall projects downwards and outward from a body part, and a second mode B in which the bottom wall is folded back inside the body part. Firstly, the second mode B is described below.

The bottom wall 4 in the second mode B has a truncated cone-shaped peripheral wall 5 extending upward from the lower end of the body part 2 into the interior of the body part. The top surface 6 of the peripheral wall is inclined obliquely downward and forward and the top surface 6 of the peripheral wall is recessed to form a liquid retaining part 7.

The liquid retaining part 7 is formed from: a bottom surface 8 which is inclined obliquely downward and backward; and a peripheral surface 9 which extends obliquely upward and outward from the peripheral edge of the bottom surface 8 and merges in the upper end of the truncated cone-shaped peripheral wall 5.

There is formed a gap S between the outer surface of the truncated cone-shaped peripheral wall 5 and the inner surface of the body part 2, in which gap liquid would remain. However, since the upper end of the truncated cone-shaped peripheral wall 5 is inclined obliquely downward and forward, the remaining liquid is allowed to flow over the upper end of the truncated cone-shaped peripheral wall 5 into the liquid retaining part 7.

Then, the first mode A is described below. In the first mode A, the bottom wall 4 is formed from: a truncated cone-shaped peripheral wall 10 is hung down from the lower end of the body part 2, and a lower surface 11 of the peripheral wall is inclined obliquely upward and forward and recessed so as to provide a bottom surface-forming surface 12 inclined obliquely upward and forward and a peripheral surface-forming surface 13 extending obliquely upward and outward from a peripheral edge of the bottom surface forming surface 12 and merging in the lower end of the peripheral wall 10.

A cylindrical leg, which is designated by the reference numeral 20, is formed by providing the lower end portion of the body part 2 with a constricted part 21 and bringing an area of the body part 2 located below the constricted part into contact with the lower end portion of the truncated cone-shaped peripheral wall 5. The cylindrical leg 20 serves as a resting part when the container is placed on a resting surface.

A liquid discharging pump, which is designated by the reference numeral 30, includes a cylinder. The cylinder has an outwardly directed flange 32 which is attached to the upper outer surface of a cylinder main body 31 hung down into the body part 2. The outwardly directed flange 32 is placed on the upper end of the opening neck part 3. Moreover, a suction valve is attached to a lower portion of the cylinder main body 31, and a fitting tube 33 for fitting a suction pipe is hung down from the lower end of the cylinder main body 31.

An actuation member, which is designated by the reference numeral 34, is fitted and inserted into the cylinder main body 31 in a vertically movable manner. The actuation member 34 has a stem 36 which extends upward from a tubular piston 35, which in turn is fitted into the cylinder main body 31 in a vertically movable manner.

A nozzle head, which is designated by the reference numeral 40, has a head main body 41 which is fitted into the upper end of the stem 36, and a nozzle 42 which projects forward from the head main body 41. A cap, which is designated by the reference numeral 45, has an inwardly directed flange. The inwardly directed flange is provided at the upper end of a tubular body screwed into the outer surface of the opening neck part 3. This inwardly directed flange presses the outwardly directed flange 32 of the cylinder main body 31 against the upper end of the opening neck part 3.

A suction pipe, which is designated by the reference numeral 50, has its upper portion fitted into the fitting tube 33 hung down from the lower end of the cylinder main body 31, and its lower end hung down into the liquid retaining part 7 of the bottom wall 4. This suction pipe 50 preferably has its lower end located at the deepest part of the liquid retaining part 7 in terms of minimizing the amount of remaining product. The suction pipe 50 preferably extends in a linear manner rather than bends in a dogleg shape as seen in conventional products. In addition, a rear part of the lower end of the suction pipe 50 is preferably inclined obliquely upward and backward.

Next, operations of the present invention are described below. During production, the bottom wall 4 is formed into the first mode A. After production, the bottom wall 4 in the first mode A is folded back inside the body part 2. Then the bottom wall 4 transforms into the second mode B. A typical condition under which the bottom wall 4 transforms into the second mode B when folded back inside the body part 2 involves making the bottom wall 4 thinner or, alternatively, making the bottom wall 4 slightly thicker to form a folding line, allowing for elastic reversal of the bottom wall.

In the second mode B, when the nozzle head 40 is pressed downward, liquid in the body part is discharged from the nozzle 42 through the suction pipe 50 and the actuation member 34 in a desired manner. When the liquid in the body part is reduced, the liquid is trapped in the liquid retaining part 7 containing a recess. In this state, the lower end of the suction pipe 50 is in close proximity to the bottom surface of the liquid retaining part 7, so that the amount of remaining liquid can be minimized. While some product would remain in a gap S between the outer surface of the peripheral wall and the inner surface of the body part, the remaining liquid cannot stay in the body part 2 since it is allowed to flow over the upper end of the truncated cone-shaped peripheral wall 5 into the liquid retaining part 7.

Another embodiment according to the present invention will now be described in detail below with reference to FIGS. 10 to 13.

A container, which is designated by the reference numeral 1, has an opening neck part 3 extending upward from the upper end of a body part 2 through a shoulder, and a liquid discharging pump mounted on the opening neck part 3 as described below.

Figure 10:
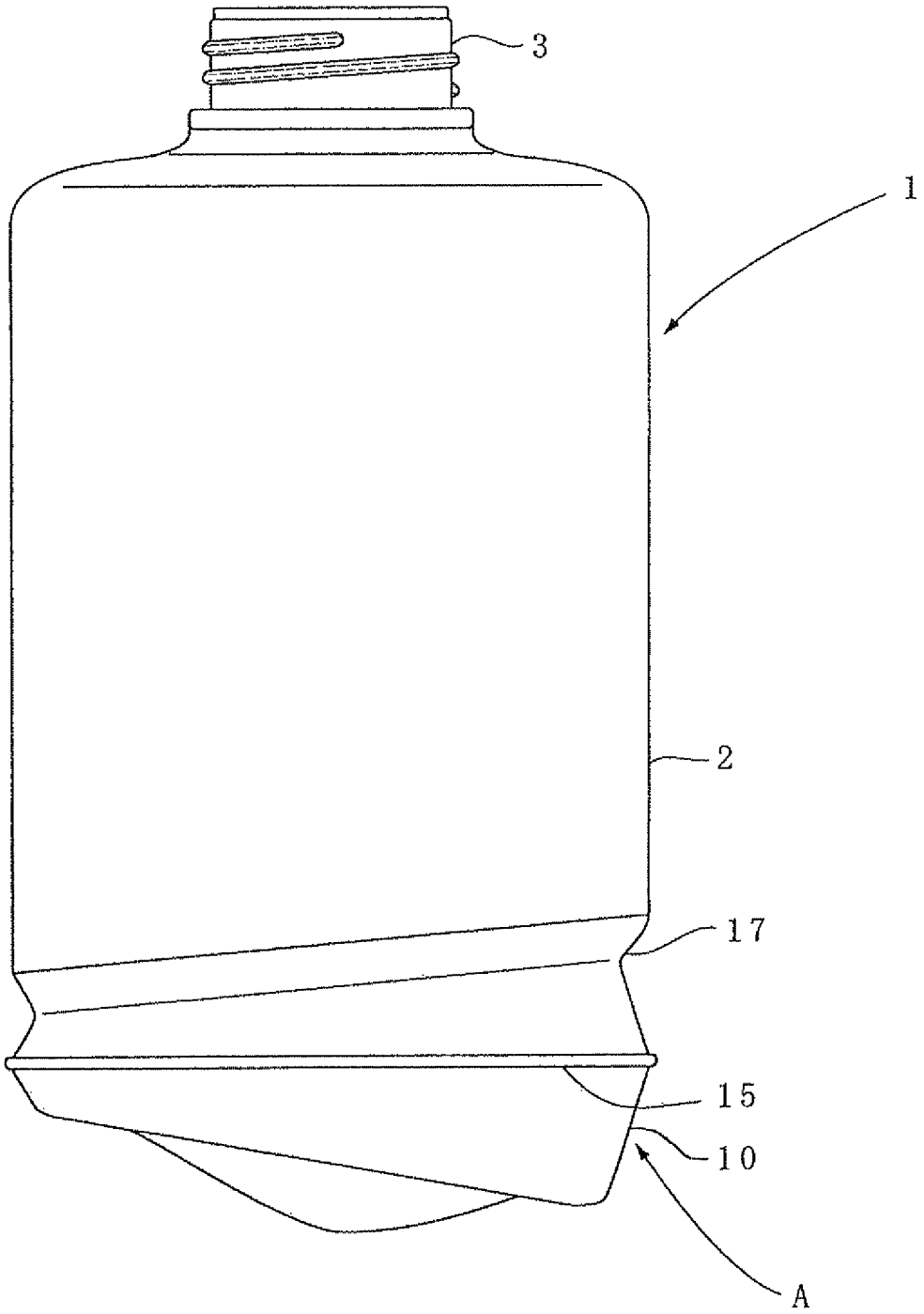
FIG. 10 is a front view illustrating a first mode A of another embodiment of the container with a folded-back bottom wall according to the present invention
Figure 11:
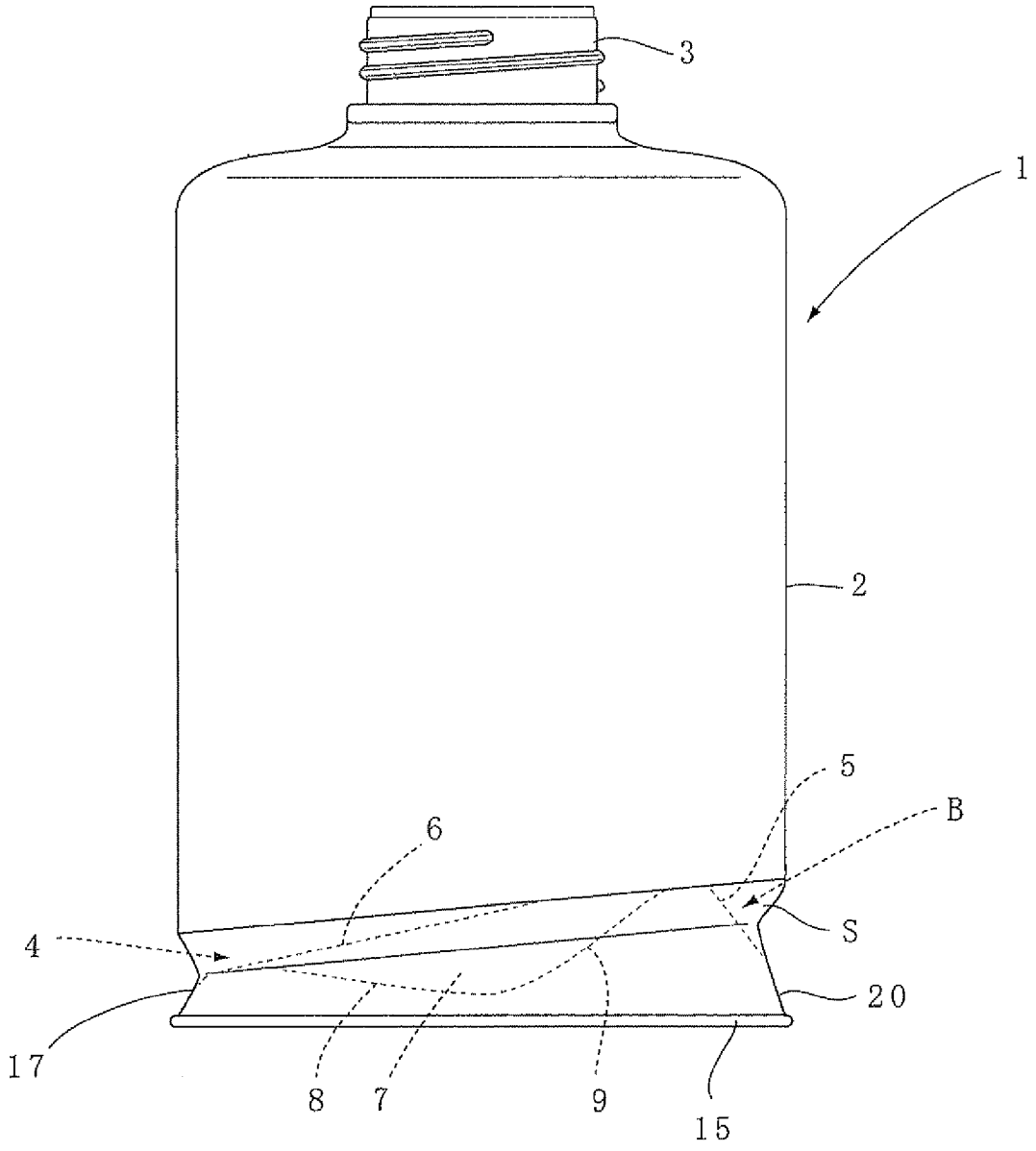
FIG. 11 is a front view illustrating a second mode B of the container with a folded-back bottom wall illustrated in FIG. 10.
Figure 12:
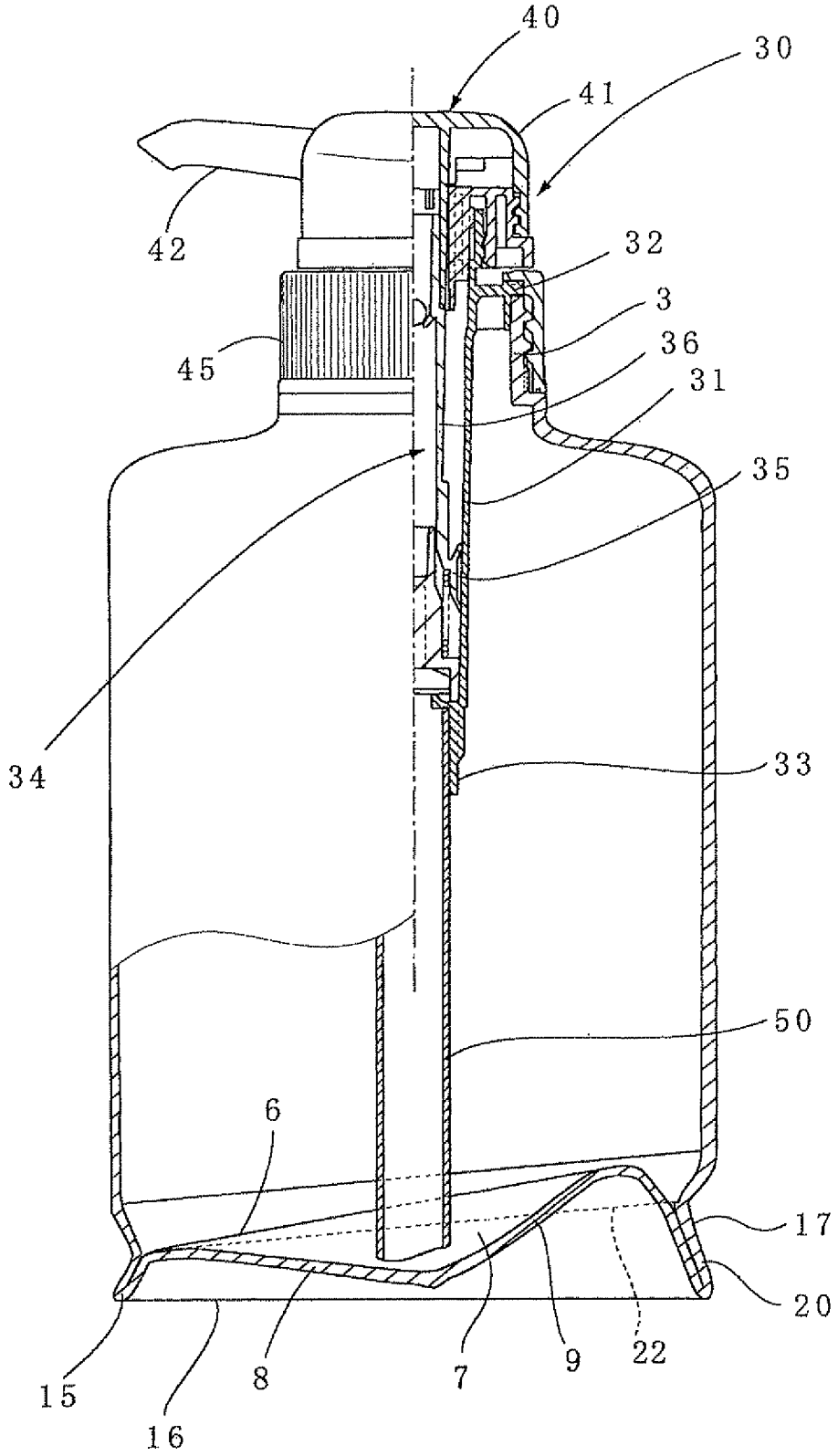
FIG. 12 is a front view illustrating the second mode B of the container illustrated in FIG. 11 with a liquid discharging pump mounted thereon.
Figure 13:
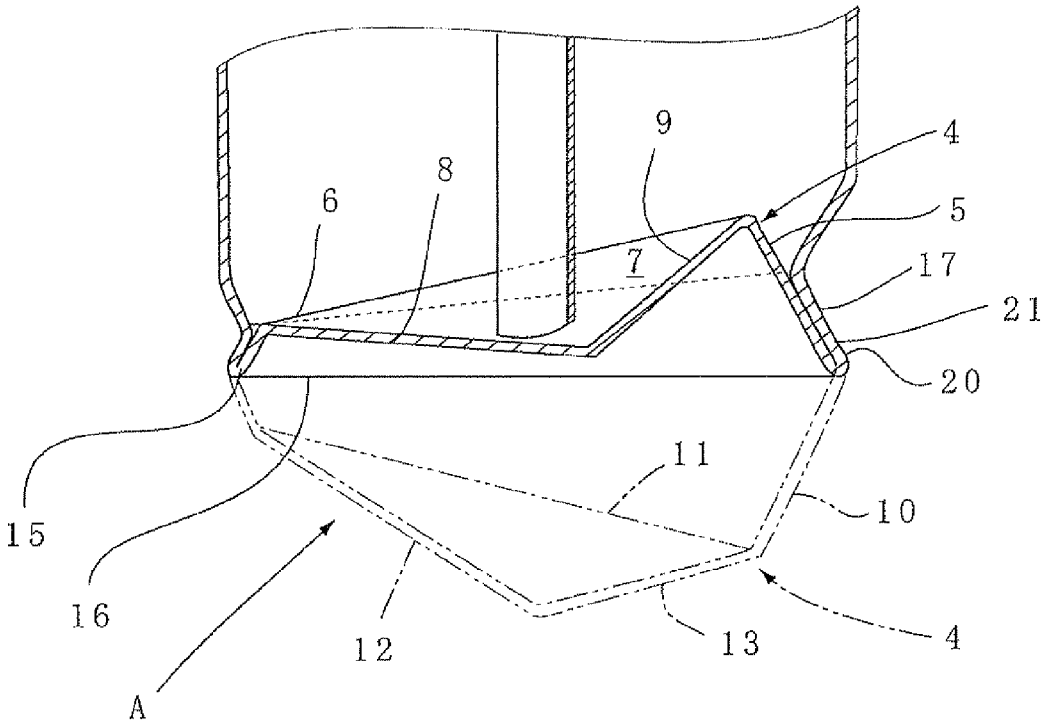
FIG. 13 is a cross-sectional view of major parts, illustrating the first mode A and the second mode B of the container with a folded-back bottom wall illustrated in FIGS. 10 to 12.

A bottom wall 4, which terminates the lower end face of the body part 2, has a first mode A in which the bottom wall projects downwards from the lower surface of a body part as illustrated in FIG. 10, and a second mode B in which the bottom wall is folded back inside the body part as illustrated in FIG. 11. Firstly, the second mode B as a final form is described below.

In the case of the bottom wall 4 in the second mode B, a truncated cone-shaped peripheral wall 5 extends upward from the lower end of the body part 2 into the interior of the body part, and the top surface 6 of the peripheral wall is inclined obliquely downward and forward. Moreover, the top surface 6 of the peripheral wall is recessed to form a liquid retaining part 7.

The liquid retaining part 7 is formed from a bottom surface 8 which is inclined obliquely downward and backward; and a peripheral surface 9 which extends obliquely upward and outward from the peripheral edge of the bottom surface 8 and merges in the upper end of the truncated cone-shaped peripheral wall 5.

While a gap S is formed between the outer surface of the truncated cone-shaped peripheral wall 5 and the inner surface of the body part 2, most of the gap may be eliminated by forming a cylindrical leg 20, which will be discussed later.

Then, the first mode A, which represents a form during molding, is described below. In the first mode A, the bottom wall 4 is formed from the following: a truncated cone-shaped peripheral wall 10 is hung down from the lower end of the body part 2, and a lower surface 11 of the peripheral wall is inclined obliquely upward and forward and then protrudes downwards so as to provide a bottom surface-forming surface 12 inclined obliquely upward and forward and a peripheral surface forming surface 13 extending obliquely upward and outward from a peripheral edge of the bottom surface forming surface 12 and merging in the lower end of the peripheral wall 10.

In addition, a boundary portion between the body part 2 and the bottom wall 4 is folded to circumferentially form an outwardly-protruding folding groove 15. The folding groove 15 is provided in order to allow the bottom wall 4 to be folded back inside the body part 2 along a part of the folding groove 15 as a folding line when the bottom wall 4 is pushed into the body part 2 for fold-back.

Preferably, the folding groove 15 has any cross sectional shape that allows for fold-back, typically including, but not limited to, round U- or square U-shapes.

Moreover, a V-groove 17 extending in the circumferential direction is formed by reducing the diameter of the body part at the lower end portion of the body part 2. Then, an area of the body part located below the bottom (having smallest diameter) of the V-groove 17 is brought into watertightly contact with the truncated cone-shaped peripheral wall to form a cylindrical leg 20, and the top surface of the cylindrical leg is formed into a tapered surface 22 which is inclined obliquely downward and forward. At this point, the front ends of the truncated cone-shaped peripheral wall 5 and the cylindrical leg 20 are of substantially the same height, while the rear end of the cylindrical leg 20 is lower than the rear end of the truncated cone-shaped peripheral wall 5.

A liquid discharging pump, which is designated by the reference numeral 30, includes a cylinder. The cylinder has an outwardly directed flange 32 which is attached to the upper outer surface of a cylinder main body 31 hung down into the body part 2. The outwardly directed flange 32 is stacked on the upper end of the opening neck part 3. Moreover, a suction valve is attached to a lower portion of the cylinder main body 31, and a fitting tube 33 for fitting a suction pipe is hung down from the lower end of the cylinder main body 31.

An actuation member, which is designated by the reference numeral 34, is fitted and inserted into the cylinder main body 31 in a vertically movable manner. The actuation member 34 has a stem 36 which extends upward from a tubular piston 35, which in turn is fitted into the cylinder main body 31 in a vertically movable manner.

A nozzle head, which is designated by the reference numeral 40, has a head main body 41 which is fitted into the upper end of the stem 36, and a nozzle 42 which projects forward from the head main body 41. A cap, which is designated by the reference numeral 45, has an inwardly directed flange. The inwardly directed flange is provided at the upper end of a tubular body screwed into the outer surface of the opening neck part 3. This inwardly directed flange presses the outwardly directed flange 32 of the cylinder main body 31 against the upper end of the opening neck part 3.

A suction pipe, which is designated by the reference numeral 50, has its upper portion fitted into the fitting tube 33 hung down from the lower end of the cylinder main body 31, and its lower end hung down into the liquid retaining part 7 of the bottom wall 4. The suction pipe 50 preferably extends in a linear manner rather than bends in a dogleg shape as seen in conventional products.

Next, operations of the present invention are described below. During molding, the bottom wall 4 is molded into the first mode A. After molding, once the bottom wall 4 in the first mode A is pushed into the body part 2, the bottom wall 4 is folded back inside the body part 2 along a part of the folding groove 15 as a folding line.

In the second mode B, when the nozzle head 40 is pressed downward, liquid in the body part is discharged from the nozzle 42 through the suction pipe 50 and the actuation member 34 in a desired manner. Even if the liquid in the body part is reduced and the liquid level of the liquid in the gap S is lowered below the level of the rear end of the truncated cone-shaped peripheral wall 5, the liquid in the gap S is still allowed to flow into the liquid-retaining part 7 since the top surface of the truncated cone-shaped peripheral wall 5 is inclined obliquely downward and forward. In addition, since the top surface of the cylindrical leg 20 is formed into a tapered surface 22 which is inclined obliquely downward and forward, in other words, as the bottom of the gap S located above the top of the cylindrical leg 20 is located at a position above the top of the front end of the truncated cone-shaped peripheral wall 5, all of the liquid in the gap S may be forced to flow into the liquid-retaining part 7 so that there is substantially no remaining liquid.

Figure 14:
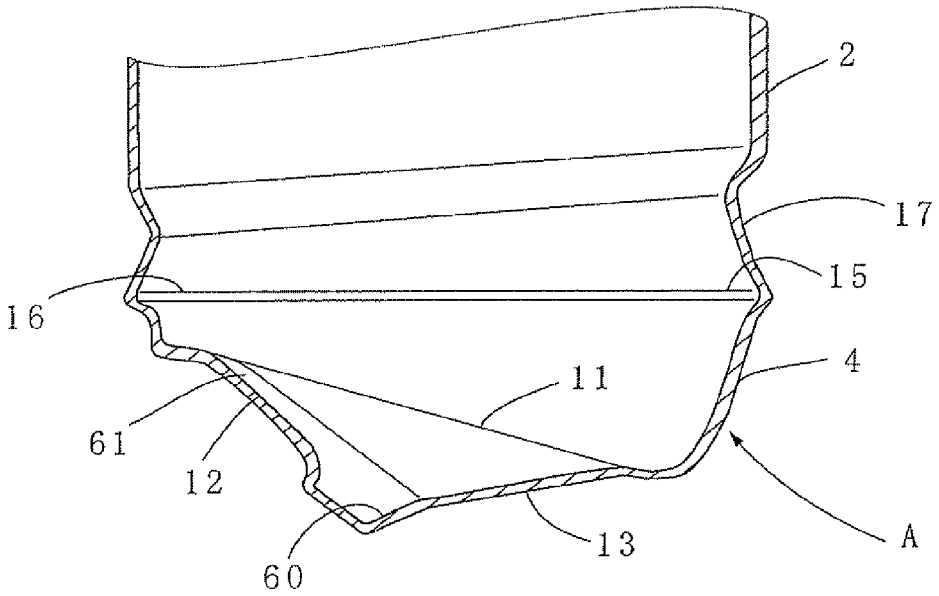
FIG. 14 is a cross-sectional view of major parts in the first mode A, illustrating another embodiment of the container with a folded-back bottom wall according to the present invention.
Figure 15:
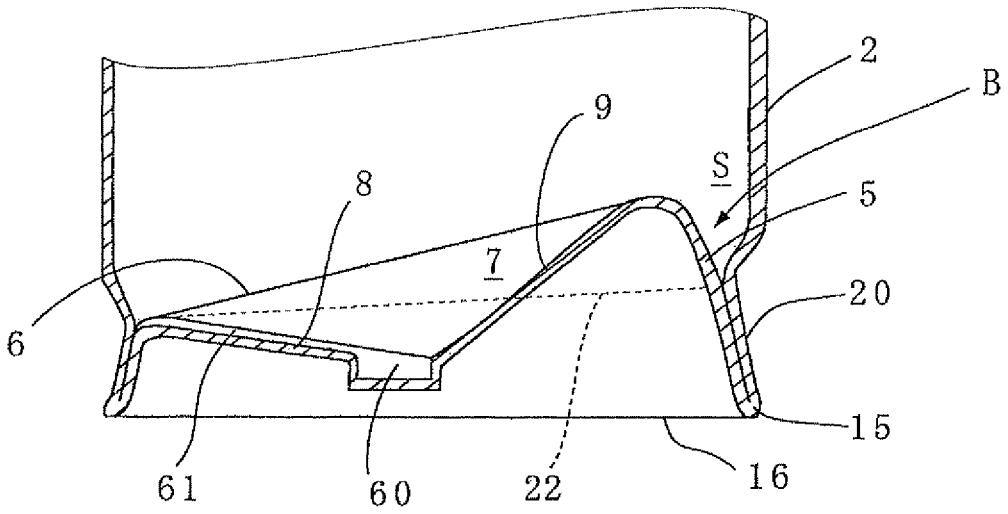
FIG. 15 illustrates the second mode B of the container with a folded-back bottom wall illustrated in FIG. 14.
Figure 16:
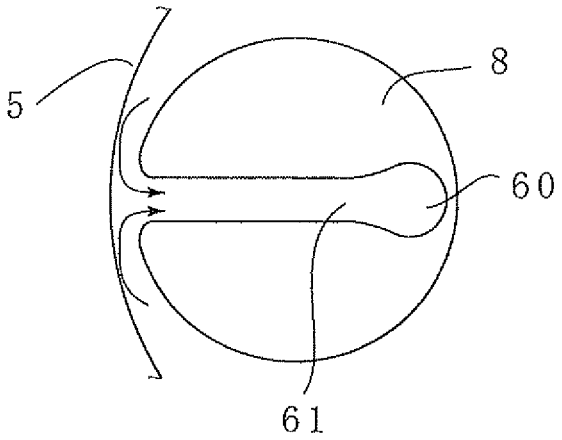
FIG. 16 is a diagram for explaining acts, illustrating the front top surface of the bottom wall of FIG. 15 together with liquid flow.

FIGS. 14 to 16 illustrate another embodiment according to the present invention. In this case, in the second mode B, a recess 60 is formed in the liquid retaining part 7 on an area of the bottom surface located below the suction pipe 50, and a recessed groove for a flow channel 61 in a forward and backward direction is provided. The recessed groove for a flow channel 61 has its front end open to the recess 60 and its rear end open to the upper end of the front part of the truncated cone-shaped peripheral wall 5, as well as a width in the horizontal direction slightly smaller than that of the recess 60, as illustrated in FIG. 16. The rear end of the recess 60 may be made to coincide with or spaced slightly forward from the rear end of the bottom surface 8. It should be noted that in the first mode A, as illustrated in FIG. 14, the recess 60 is formed by making the rear end of the bottom surface 8 protruding obliquely downward and forward. Otherwise are the same as those described in relation to the embodiment illustrated in FIGS. 10 to 13, and so the same components have been given the same reference numerals and will not be explained again here.

With this configuration, when the amount of remaining liquid is reduced, any liquid in the liquid retaining part 7 flows through the recessed groove for a flow channel 61 so as to be trapped in the recess 60. Hence, a further reduction in the amount of remaining product may be achieved by positioning the lower end of the suction pipe 50 in the recess 60

Industrial Applicability

The present invention is applicable to a container with a folded-back bottom wall in which a bottom wall is folded back inside a body part after molding, and particularly to the field of containers adapted to minimize the amount of remaining product in a container body equipped with a discharge mechanism such as a pump.

REFERENCE NUMERALS

1 Container
2 Body part
3 Opening neck part
4 Bottom wall
5 Truncated cone-shaped peripheral wall
6 Top surface of peripheral wall
7 Liquid retaining part
8 Bottom surface
9 Peripheral surface
10 Peripheral wall
11 Bottom surface of peripheral wall
12 Bottom surface forming surface
13 Peripheral surface forming surface
15 Folding groove
16 Opening upper edge
17 V-groove
20 Cylindrical leg
21 Constricted part
22 Tapered surface
30 Liquid discharging pump
31 Cylinder main body
32 Outwardly directed flange
33 Fitting tube
34 Actuation member
35 Tubular piston
36 Stem
40 Nozzle head
41 Head main body
42 Nozzle
45 Cap
50 Suction pipe
60 Recess
61 Recessed groove for flow channel
A First mode
B Second mode
S Gap

The invention claimed is:

1. A container with a folded-back bottom wall comprising:
a bottom wall;
a body part, the container being configured to transform into a first mode in which the bottom wall projects downward from a lower surface of the body part and into a second mode in which the bottom wall is folded inside the body part;
a boundary portion between the bottom wall and the body part, the boundary portion being folded to have an outwardly-convex shape so that a folding groove is circumferentially formed in the first mode and so that the bottom wall is folded back inside the body part at the folding groove to transform into the second mode;
an opening neck part extending upward from an upper end of the body part;
a liquid discharging pump mounted on the opening neck part; and
a suction pipe extending down from the liquid discharging pump into the body part in a linear manner, the suction pipe, upon actuation of the liquid discharging pump, allowing liquid in the body part to be sucked up and discharged through the suction pipe, wherein
the bottom wall has a truncated cone-shaped peripheral wall extending upward from a lower end of the body part into the interior of the body part, a top surface of the peripheral wall being inclined obliquely downward and forward, and the top surface being recessed to form a liquid retaining part;
the body part comprises a V-groove extending along a circumference of a part of a lower portion of the body part, the V-groove being formed by reducing the diameter of the body part;
an area of the body part located below a bottom part of the V-groove is brought into watertight contact with the truncated cone-shaped peripheral wall to form a cylindrical leg, a top surface of the cylindrical leg being formed into a tapered surface inclined obliquely downward and forward; and
liquid does not enter the cylindrical leg.

2. The container with a folded-back bottom wall according to claim 1, wherein
a folding line is formed along an opening upper edge of the folding groove as the bottom wall is folded back inside the body part.

3. The container with a folded-back bottom wall according to claim 1, wherein
the folding groove has a cross sectional shape of a round U- or square U-shape.

4. The container with a folded-back bottom wall according to claim 1, wherein
in the second mode, a constricted part is provided at a lower end portion of the body part, and an area of the body part located below the constricted part is brought into contact with a lower portion of the truncated cone-shaped peripheral wall to form a cylindrical leg configured to support the container upon a surface.

5. A container with a folded-back bottom wall comprising:
a bottom wall;
a body part, the container being configured to transform into a first mode in which the bottom wall projects downward from a lower surface of the body part and into a second mode in which the bottom wall is folded inside the body part;
a boundary portion between the bottom wall and the body part, the boundary portion being folded to have an outwardly-convex shape so that a folding groove is circumferentially formed in the first mode and so that the bottom wall is folded back inside the body part at the folding groove to transform into the second mode;

an opening neck part extending upward from an upper end of the body part;

a liquid discharging pump mounted on the opening neck part; and a suction pipe extending down from the liquid discharging pump into the body part in a linear manner, the suction pipe, upon actuation of the liquid discharging pump, allowing liquid in the body part to be sucked up and discharged through the suction pipe, wherein the bottom wall has in the second mode, a truncated cone-shaped peripheral wall extending upward from a lower end of the body part into the interior of the body part;

the body part comprises a V-groove extending along a circumference of a part of a lower portion of the body part, the V-groove being formed by reducing the diameter of the body part;

an area of the body part located below a bottom part of the V-groove is brought into watertight contact with the truncated cone-shaped peripheral wall to form a cylindrical leg, a top surface of the cylindrical leg being formed into a tapered surface inclined obliquely downward and forward;

liquid does not enter the cylindrical leg;

a top surface of the peripheral wall being inclined obliquely downward and forward, the top surface of the peripheral wall being recessed to form a liquid retaining part so that any liquid remaining in a gap between an outer surface of the truncated cone-shaped peripheral wall and an inner surface of the body part is allowed to flow over an upper end of the truncated cone-shaped peripheral wall into the liquid retaining part, and a lower end of the suction pipe extends in a linear manner into the liquid retaining part.

6. The container with a folded-back bottom wall according to claim 5, wherein in the second mode, a constricted part is provided at a lower end portion of the body part, and an area of the body part located below the constricted part is brought into contact with a lower portion of the truncated cone-shaped peripheral wall to form a cylindrical leg configured to support the container upon a surface.

7. The container with a folded-back bottom wall according to claim 5, wherein the liquid retaining part includes:

a bottom surface inclined obliquely downward and backward, and a peripheral surface extending obliquely upward and outward from a peripheral edge of the bottom surface and merging with an upper end of the truncated cone-shaped peripheral wall.

8. The container with a folded-back bottom wall according to claim 5, wherein in the first mode, a peripheral wall is hung down from a lower end of the body part, and a lower surface of the peripheral wall is inclined obliquely upward and forward and recessed so as to provide a bottom surface-forming surface inclined obliquely upward and forward and a peripheral surface-forming surface extending obliquely upward and outward from a peripheral edge of the bottom surface-forming surface and merging in a lower end of the peripheral wall.

9. The container with a folded-back bottom wall according to claim 5, wherein at least rear part of a lower surface of the suction pipe is inclined obliquely upward and backward.

10. A container with a folded-back bottom wall comprising:

a bottom wall;

a body part, the container being configured to transform into a first mode in which the bottom wall projects downward from a lower surface of the body part and into a second mode in which the bottom wall is folded inside the body part;

a boundary portion between the bottom wall and the body part, the boundary portion being folded to have an outwardly-convex shape so that a folding groove is circumferentially formed in the first mode and so that the bottom wall is folded back inside the body part at the folding groove to transform into the second mode;

an opening neck part extending upward from an upper end of the body part;

a liquid discharging pump mounted on the opening neck part; and a suction pipe extending down from the liquid discharging pump into the body part, the suction pipe, upon actuation of the liquid discharging pump, allowing liquid in the body part to be sucked up and discharged through the suction pipe, wherein the body part comprises a V-groove extending along a circumference of a part of a lower portion of the body part, the V-groove being formed by reducing the diameter of the body part, in the second mode, the bottom wall has a truncated cone-shaped peripheral wall extending upward from a lower end of the body part into the interior of the body part; a top surface of the peripheral wall inclined obliquely downward and forward, and the top surface of the peripheral wall being recessed to form a liquid retaining part, an area of the body part located below a bottom part of the V-groove is brought into watertight contact with the truncated cone-shaped peripheral wall to form a cylindrical leg, a top surface of the cylindrical leg being formed into a tapered surface inclined obliquely downward and forward;

liquid does not enter the cylindrical leg; and the suction pipe extends in a linear manner into the liquid retaining part.

11. The container with a folded-back bottom wall according to claim 10, wherein a recess is formed in the liquid retaining part on an area of a bottom surface located below the suction pipe, and a recessed groove for a flow channel is provided, the recessed groove having a front end open to the recess and a rear end open to a lower end of a front part of the truncated cone-shaped peripheral wall.

12. The container with a folded-back bottom wall according to claim 10, wherein a boundary portion between the bottom wall and the body part is folded to have an outwardly-convex shape so that a folding groove is circumferentially formed, and a folding line is formed along an opening upper edge of the folding groove as the bottom wall is folded inside the body part.

13. The container with a folded-back bottom wall according to claim 1, wherein the suction pipe extends linearly over an entire length of the suction pipe.

14. The container with a folded-back bottom wall according to claim 1, wherein the suction pipe has a length that is less than or equal to a distance between the liquid discharging pump and the liquid retaining part of the bottom wall.

15. The container with a folded-back bottom wall according to claim 1, wherein the suction pipe extends linearly between the liquid discharging pump and a lower end of the suction pipe that opens into the liquid retaining part.

16. The container with a folded-back bottom wall according to claim 5, wherein the suction pipe extends linearly between the liquid discharging pump and a lower end of the suction pipe that opens into the liquid retaining part.

17. The container with a folded-back bottom wall according to claim 10, wherein the suction pipe extends linearly between the liquid discharging pump and a lower end of the suction pipe that opens into the liquid retaining part.

18. The container with a folded-back bottom wall according to claim 1, wherein the truncated cone-shaped peripheral wall does not extend upward into the interior of the body part in the first mode.

19. The container with a folded-back bottom wall according to claim 5, wherein the truncated cone-shaped peripheral wall does not extend upward into the interior of the body part in the first mode.

20. The container with a folded-back bottom wall according to claim 10, wherein the truncated cone-shaped peripheral wall does not extend upward into the interior of the body part in the first mode.

* * * * *